US009010911B2

(12) United States Patent
Clarke

(10) Patent No.: US 9,010,911 B2
(45) Date of Patent: Apr. 21, 2015

(54) CONTINUOUS INKJET DROP GENERATION DEVICE

(75) Inventor: Andrew Clarke, Haslingfield (GB)

(73) Assignee: Eastman Kodak Company, Rochester, NY (US)

( * ) Notice: Subject to any disclaimer, the term of this patent is extended or adjusted under 35 U.S.C. 154(b) by 624 days.

(21) Appl. No.: 12/664,937

(22) PCT Filed: Jun. 27, 2008

(86) PCT No.: PCT/GB2008/002208
§ 371 (c)(1),
(2), (4) Date: Dec. 16, 2009

(87) PCT Pub. No.: WO2009/004312
PCT Pub. Date: Jan. 8, 2009

(65) Prior Publication Data

US 2010/0188466 A1 Jul. 29, 2010

(30) Foreign Application Priority Data

Jul. 3, 2007 (GB) ..... 0712860.6

(51) Int. Cl.

| | |
|---|---|
| ***B41J 2/02*** | (2006.01) |
| ***B41J 2/03*** | (2006.01) |
| ***B05B 7/04*** | (2006.01) |
| ***B05B 17/04*** | (2006.01) |
| *B01F 13/00* | (2006.01) |
| *B05B 7/06* | (2006.01) |

(52) U.S. Cl.
CPC ..... *B41J 2/03* (2013.01); *B01F 13/0062* (2013.01); *B01F 13/0079* (2013.01); *B05B 7/0408* (2013.01); *B05B 7/0433* (2013.01); *B05B 7/061* (2013.01); *B05B 7/065* (2013.01); *B05B 17/04* (2013.01)

(58) Field of Classification Search
USPC ..... 347/75
See application file for complete search history.

(56) References Cited

U.S. PATENT DOCUMENTS

| | | | | |
|---|---|---|---|---|
| 7,759,111 | B2 | 7/2010 | Lee et al. | |
| 2001/0015735 | A1 * | 8/2001 | Matsumoto | 347/20 |

FOREIGN PATENT DOCUMENTS

| | | |
|---|---|---|
| JP | 2005-152740 | 6/2005 |

* cited by examiner

*Primary Examiner* — Uyen Chau N Le
*Assistant Examiner* — Hoang Tran
(74) *Attorney, Agent, or Firm* — William R. Zimmerli

(57) ABSTRACT

A droplet generating device for use as part of a continuous inkjet printer comprises a set of channels for providing a composite flow of a first fluid (11) surrounded by a second fluid (12) and an expansion cavity (3) having an entry orifice (2) and an exit orifice (4). The cross sectional area of the cavity is larger than the cross sectional area of either orifice such that the composite flow breaks up to form droplets of the first fluid within the second-fluid within the cavity, the exit orifice also forming a nozzle of an inkjet device, the passage of the droplets of the first fluid through the exit orifice causing the composite jet to break into composite droplets.

20 Claims, 8 Drawing Sheets

CONTINUOUS INKJET DROP GENERATION DEVICE

FIELD OF THE INVENTION

This invention relates to continuous inkjet devices, in particular to droplet generation.

BACKGROUND OF THE INVENTION

With the growth in the consumer printer market inkjet printing has become a broadly applicable technology for supplying small quantities of liquid to a surface in an image-wise way. Both drop-on-demand and continuous drop devices have been conceived and built. Whilst the primary development of inkjet printing has been for aqueous based systems with some applications of solvent based systems, the underlying technology is being applied much more broadly.

In order to create the stream of droplets, a droplet generator is associated with the print head. The droplet generator stimulates the stream of fluid within and just beyond the print head, by a variety of mechanisms known in the art, at a frequency that forces continuous streams of fluid to be broken up into a series of droplets at a specific break-off point within the vicinity of the nozzle plate. In the simplest case, this stimulation is carried out at a fixed frequency that is calculated to be optimal for the particular fluid, and which matches a characteristic drop spacing of the fluid jet ejected from the nozzle orifice. The distance between successively formed droplets, S, is related to the droplet velocity, $U_{drop}$, and the stimulation frequency, f, by the relationship: $U_{drop}=f\cdot S$. The droplet velocity is related to the jet velocity, $U_{jet}$, via $$U_{drop} = U_{jet} - \frac{\sigma}{\rho U_{jet} R}$$

where is the σ the surface tension (N/m), ρ the liquid density (kg/m$^3$) and R the jet's unperturbed radius (m).

U.S. Pat. No. 3,596,275, discloses three types of fixed frequency generation of droplets with a constant velocity and mass for a continuous inkjet recorder. The first technique involves vibrating the nozzle itself. The second technique imposes a pressure variation on the fluid in the nozzle by means of a piezoelectric transducer, placed typically within the cavity feeding the nozzle. A third technique involves exciting a fluid jet electrohydrodynamically (EHD) with an EHD droplet stimulation electrode.

Additionally, continuous inkjet systems employed in high quality printing operations typically require small closely spaced nozzles with highly uniform manufacturing tolerances. Fluid forced under pressure through these nozzles typically causes the ejection of small droplets, on the order of a few pico-liters in size, travelling at speeds from 10 to 50 meters per second. These droplets are generated at a rate ranging from tens to many hundreds of kilohertz. Small, closely spaced nozzles, with highly consistent geometry and placement can be constructed using micro-machining technologies such as those found in the semiconductor industry. Typically, nozzle channel plates produced by these techniques are made from materials such as silicon and other materials commonly employed in micromachining manufacture (MEMS). Multi-layer combinations of materials can be employed with different functional properties including electrical conductivity. Micro-machining technologies may include etching. Therefore through-holes can be etched in the nozzle plate substrate to produce the nozzles. These etching techniques may include wet chemical, inert plasma or chemically reactive plasma etching processes. The micro-machining methods employed to produce the nozzle channel plates may also be used to produce other structures in the print head. These other structures may include ink feed channels and ink reservoirs. Thus, an array of nozzle channels may be formed by etching through the surface of a substrate into a large recess or reservoir which itself is formed by etching from the other side of the substrate.

There are many known examples of inkjet printing. U.S. Pat. No. 5,801,734 discloses a method of continuous inkjet printing. U.S. Pat. No. 3,596,275 discloses methods of stimulating a jet of liquid. US 2006/0092230 discloses a method of charging an insulating ink liquid for use in a continuous inkjet device. U.S. Pat. No. 7,192,120 is representative of a number of patents disclosing novel drop on demand inkjet devices.

Problem to be Solved by the Invention

Conventional continuous inkjet devices employ a drilled nozzle plate. Ink, or more generally a liquid, is applied to this plate under pressure causing jets of ink, or liquid, to emerge at high velocity. Such a jet of liquid is intrinsically unstable and will break up to form a series of droplets. This process is known as the Rayleigh-Plateau instability. Whilst the physics of this break up lead to a reasonably well defined frequency and droplet size, in order to be useful for printing, a perturbation must be provided such that the break up is controlled to give a fixed frequency and drop size. Moreover the distance from the nozzle plate at which the jet breaks to form droplets is critical since, conventionally, an electrode is required at this point in order to charge the droplets as they form. The placement of this electrode with respect to the jet is also critical and therefore leads to significant engineering issues. The perturbation required is achieved by vibrating the nozzle plate or other element of the fluid flow path with a piezoelectric system, usually at resonance and possibly with an acoustic cavity at resonance. This vibration provides a high energy pressure perturbation which initiates drop break up and thereby provides a regular supply of fixed size drops to print with.

The necessity of using a piezo system at high frequency, together with aspects of the drop break-up process impose severe restrictions on the ink, or liquid, properties. Thus the ink most commonly has a viscosity close to that of water. This in turn implies severe restrictions on the ink components allowable in the process. Further the use of piezo systems is fundamentally difficult to achieve with standard MEMs fabrication processes. Thus there is little possibility of significantly enhancing resolution by providing smaller, more closely spaced nozzles.

A further problem of inkjet printing in general and continuous inkjet printing in particular is the amount of water or solvent that is printed with many ink formulations. This is often necessary to ensure the ink viscosity is appropriate for the process. However there is then a further necessity to dry the ink on the printed surface without disturbing the pattern created.

SUMMARY OF THE INVENTION

The invention aims to provide a droplet generator for use in a continuous inkjet device wherein the initial perturbation is predominantly provided by the fluid flow.

According to the present invention there is provided a droplet generating device for use as part of a continuous inkjet printer comprising a set of channels for providing a composite flow of a first fluid surrounded by a second fluid and an expansion cavity having an entry orifice and an exit orifice, the cross sectional area of the cavity being larger than the cross sectional area of either orifice such that the composite flow breaks up to form droplets of the first fluid within the second fluid within the cavity, the exit orifice also forming a nozzle of an inkjet device, the passage of the droplets of the first fluid through the exit orifice causing the composite jet to break into composite droplets.

Advantageous Effect of the Invention

The present invention enables high energy jet break up without vibrational energy input and therefore without the use of piezoelectric devices. The droplet generation device can therefore be made entirely via MEMS fabrication processes thereby allowing higher nozzle density than conventionally allowed. Further, such fabrication technology allows integration of the droplet generator with charging apparatus and thereby alleviates significant alignment issues of the two subsystems.

At least one embodiment of the device enables printing with lower quantities of liquid and thereby reduces issues related to drying the ink printed on the substrate.

BRIEF DESCRIPTION OF THE DRAWINGS

The invention will now be described with reference to the accompanying drawings in which.

DETAILED DESCRIPTION OF THE INVENTION

Figure 2:
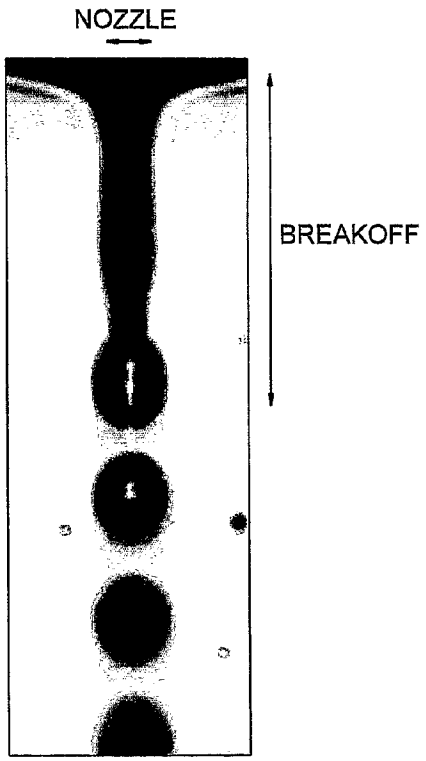
FIG. 2 is a copy of a photograph showing the jet as it exits the nozzle.

The ability to form a fluid jet of a first fluid within an immiscible second fluid within a microfluidic device is known in the art. However, the modes of operation usual for these devices are either a "geometry controlled" or a "dripping" mode, where monodisperse drops of the first fluid are directly formed. These modes are explained in S. L. Anna, H. C. Mayer, Phys. Fluids 18, 121512 (2006). However, it is also well understood that as the fluid flow velocity increases the first fluid passes the orifice responsible for the "geometry controlled" or "dripping" modes and forms a jet in the area beyond. This jet then breaks up into droplets controlled predominantly by interfacial or surface tension. This jet break up mode is termed the Rayleigh-Plateau instability and produces polydisperse droplets of the first fluid. If the first fluid is gaseous then of course the droplets of the first fluid are bubbles.

It is a remarkable and hitherto unknown fact that the break up of a jet of a first fluid within an immiscible second fluid within a channel can be regularised by providing, after the jet is formed, an expansion of the channel, a cavity, and an exit orifice such that as the droplets of the first fluid that are formed from the jet pass through the exit orifice, they perturb the flow within the cavity. In order to achieve a significant flow perturbation, the droplet cross-sectional area should be an appreciable fraction of the exit orifice cross sectional area perpendicular to the flow direction. In preference the droplet cross-sectional area should be greater than about one third of the exit orifice cross sectional area perpendicular to the flow direction. The flow perturbation is conducted back to the entrance orifice, i.e, where the channel first expands, and therefore perturbs the jet as it enters the cavity. Since the jet is intrinsically unstable this will subsequently cause the jet to break in a position commensurate with the same disturbance as convected by the jet. The droplet so formed will then in turn provide a flow perturbation as it exits the cavity at the exit orifice. Thus there will be provided reinforcement of the intrinsic break-up of the jet. The frequency at which this reinforcement occurs will correspond, via the jet velocity within the cavity, to a particular wavelength. The flow feedback process means that the initial perturbation must have a fixed phase relation to the exit of a droplet of the first fluid and therefore the cavity will ensure a fixed frequency is chosen for a given set of flow conditions. The frequency chosen, f in Hz, will be approximately $$f = (n + \beta)\frac{U_j}{L}$$

where $U_j$ is the velocity of the jet of the first fluid (m/s), L is the length of the cavity (m), n is an integer and β is a number between 0 and 1 that takes account of end effects. This is quite analogous to the frequency selection within a laser cavity.

It will be appreciated that the wavelength will depend on the diameter of the jet of the first fluid. Further it will be appreciated that the length of jet required before break-up is observed is dependent on the interfacial tension between the first fluid and the second fluid, the viscosities of the first fluid and the second fluid and the velocity of flow. Thus the break-up length and therefore the length of the cavity is reduced by using a higher interfacial tension, a lower viscosity of the first fluid or a slower flow velocity. It is further possible to modify the flow velocity within the cavity without changing the exit velocity by increasing the dimension of the cavity perpendicular to the flow.

Figure 1:
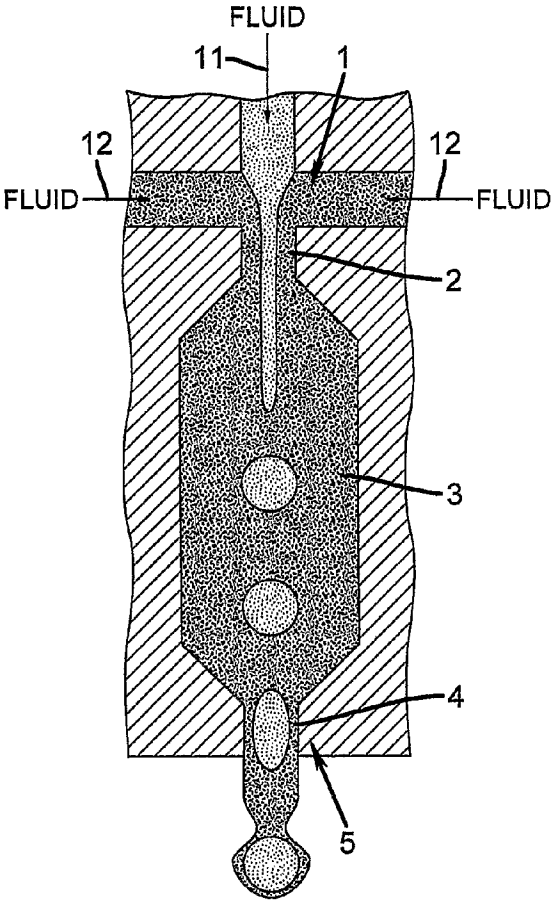
FIG. 1 is a schematic diagram of a droplet generator device according to the invention.

FIG. 1 is a schematic diagram of a droplet generator device in accordance with the invention.

A cross flow focusing device 1 is located upstream of an expansion cavity 3. The expansion cavity 3 is provided with an entrance orifice 2 and an exit orifice 4. A nozzle 5 is located immediately beyond the exit orifice 4.

The cross flow focussing device 1 is a standard device for creating a co-flowing liquid jet.

In FIG. 1 a jet of a first fluid, 11, surrounded by a second fluid 12, is passed into a broad channel or cavity 3, via the entrance orifice 2 such that the second fluid fills the volume around the jet. The cavity 3 has an exit orifice 4.

It is useful to consider the linear equations of a jet in air;

$$L_B = \frac{1}{U\alpha}\ln\left(\frac{R}{\xi_i}\right)$$

where $L_B$ is the break off length of the jet (m) of the first fluid measured from the entrance to the cavity, U is the fluid velocity (m/s), R is the jet radius (m), $\alpha$ is the growth rate ($s^{-1}$) for a frequency of interest (e.g. the Rayleigh frequency $f_R$~U/(9.02R) [$f_R$ in Hz]) and $\xi_i$ is the size of the initial perturbation (m). The growth rate may be obtained from the following equation $$\alpha^2 = \frac{3\eta(kR)^2}{\rho R^2}\alpha - \frac{\sigma}{2\rho R^3}(1-(kR)^2)(kR)^2 = 0$$

where $\eta$ is the viscosity of the first fluid (Pa·s), $\sigma$ is the interfacial tension (N/m) and k is the wavevector ($m^{-1}$) ($k=2\pi f/U$). Thus the break off length $L_B$ may be estimated and compared with the cavity length, L. The flow velocity, surface tension and length of the cavity should be mutually arranged such that the jet of the first fluid 11 breaks within the cavity. In a preferred embodiment $\frac{1}{3}L<L_B<L$.

The device as shown in FIG. 1 therefore locks to a particular frequency and forms a suitable droplet generator for a continuous inkjet printing device.

FIG. 2 is a copy of a photograph showing the break up of the jet external to the device. Note that the length required for break-up is remarkably shorter than for a jet of the same composition issuing at substantially the same velocity but without regular break-up of the first fluid within the cavity.

Figure 3:
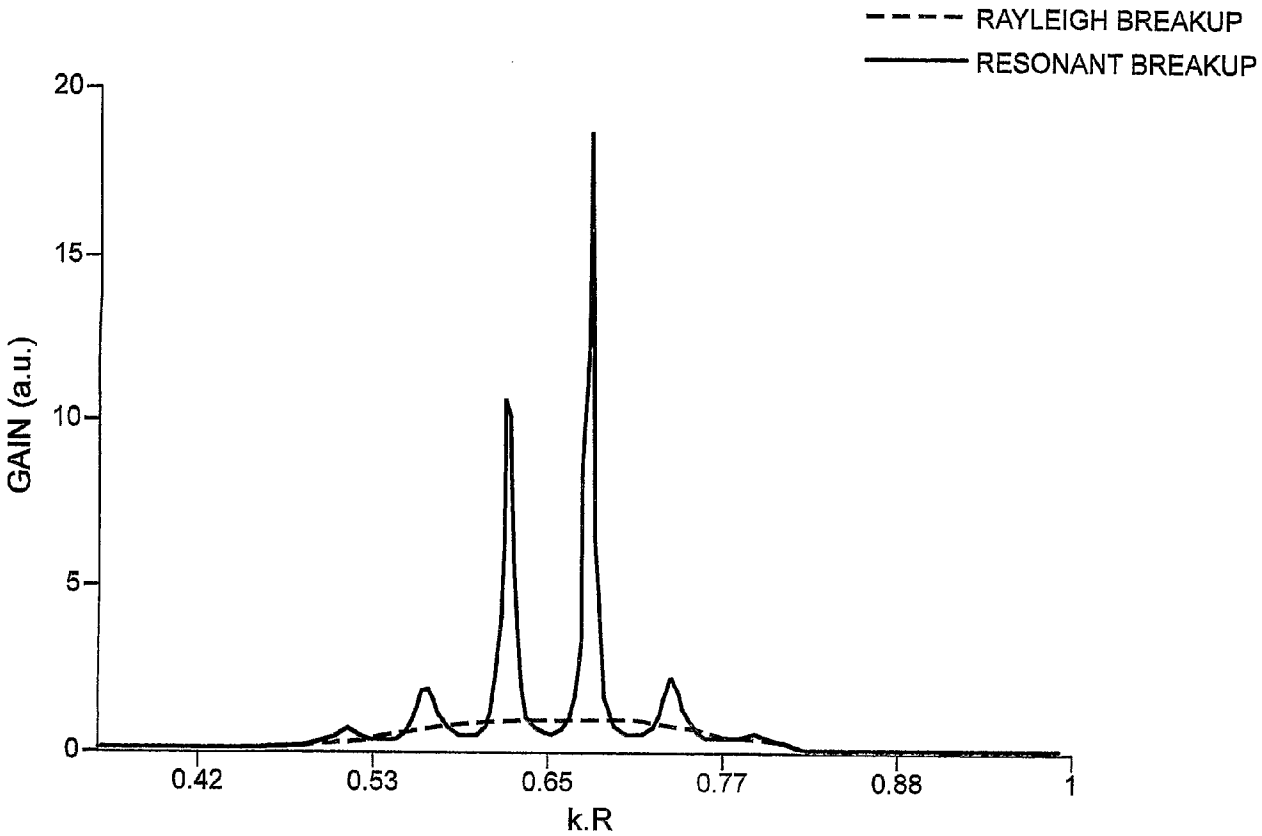
FIG. 3 is a graph estimating the resonant behaviour of the device.

FIG. 3 is a graph illustrating an estimate of the resonant behaviour of the device. In a linear approximation of jet break-up typically it is assumed that an initial perturbation will grow exponentially with a growth rate $\alpha$ as used above. Thus an initial perturbation will grow as $\exp(\alpha*\tau)$, the normalised value of which, $K_0$, describes the growth of a perturbation at a particular frequency (i.e. dimensionless wavevector kR) relative to the growth rate of the same size of perturbation at the Rayleigh frequency (dimensionless wavevector, $kR_m$), $$\xi = \xi_i\exp(\alpha t),\ \xi_0 = \xi_i\exp(\alpha_0 t)$$

$$\alpha = \alpha(kR),\ \alpha_0 = \alpha(kR_m)$$

$$K_0 = \frac{\xi}{\xi_0} = \exp((\alpha-\alpha_0)\tau_B)$$

where $\alpha_0$ is the growth factor (1/s) at the Rayleigh wavelength ($kR_m$) and $\tau_B$ is the time for the jet of the first fluid to break up into droplets (s) at the Rayleigh frequency $$t_B = \frac{1}{\alpha_0}\ln\left(\frac{R_0}{\xi_i}\right)$$

where $R_0$ is the jet radius. So an initial perturbation to the first fluid, $P_{i0}$, grows and forms a droplet which then exits the device creating a flow perturbation, $P_{o0}$ proportional to the droplet size.

$$P_{o0} = P_{i0}\left(\frac{kR_m}{kR}\right)^{1/3}K_0$$

A proportion, $K_f$, of this perturbation is fed back within the cavity to the input perturbation, the sum of which in turn causes a flow perturbation. Hence, the summed input perturbation, $P_i$, is $$P_{i1} = (P_{i0} + \sin(\phi)K_f P_{o0})\left(\left(\frac{kR_m}{kR}\right)^{1/3}K_0\right)$$

where $\phi$ is the relative phase of the output perturbation seen fed back to the input (=k·L with L the effective cavity length). This progression therefore leads to an infinite sum which gives the overall gain of the system relative to the gain of a free Rayleigh jet at the Rayleigh frequency as $$\text{Gain} = \frac{\left(\frac{kR_m}{kR}\right)^{1/3}K_0}{1-K_f\sin(\phi)\left(\frac{kR_m}{kR}\right)^{1/3}K_0}.$$

In FIG. 3, Gain is plotted against the dimensionless wavevector, kR for the following parameter values: L=500 μm, $R_0$=4.4 μm, $K_f$=0.97, $\sigma$=50 mN/m, $\rho$=0.973 kg/$m^3$, $\eta$=0.9 mPa·s. Also plotted is the gain of a free Rayleigh jet in air. Given incompressible fluids and hard walls, we would expect that a flow perturbation at the exit will be essentially equal to the flow perturbation at the input and therefore that $K_f$ will be close to 1. It should be appreciated that the perturbation created at the exit, $P_o$, will additionally perturb the jet external to the device and cause it to break up in a highly regular manner. That is, the resonant cavity drives a high energy perturbation of the exterior jet causing rapid and regular breakup.

Figure 4:
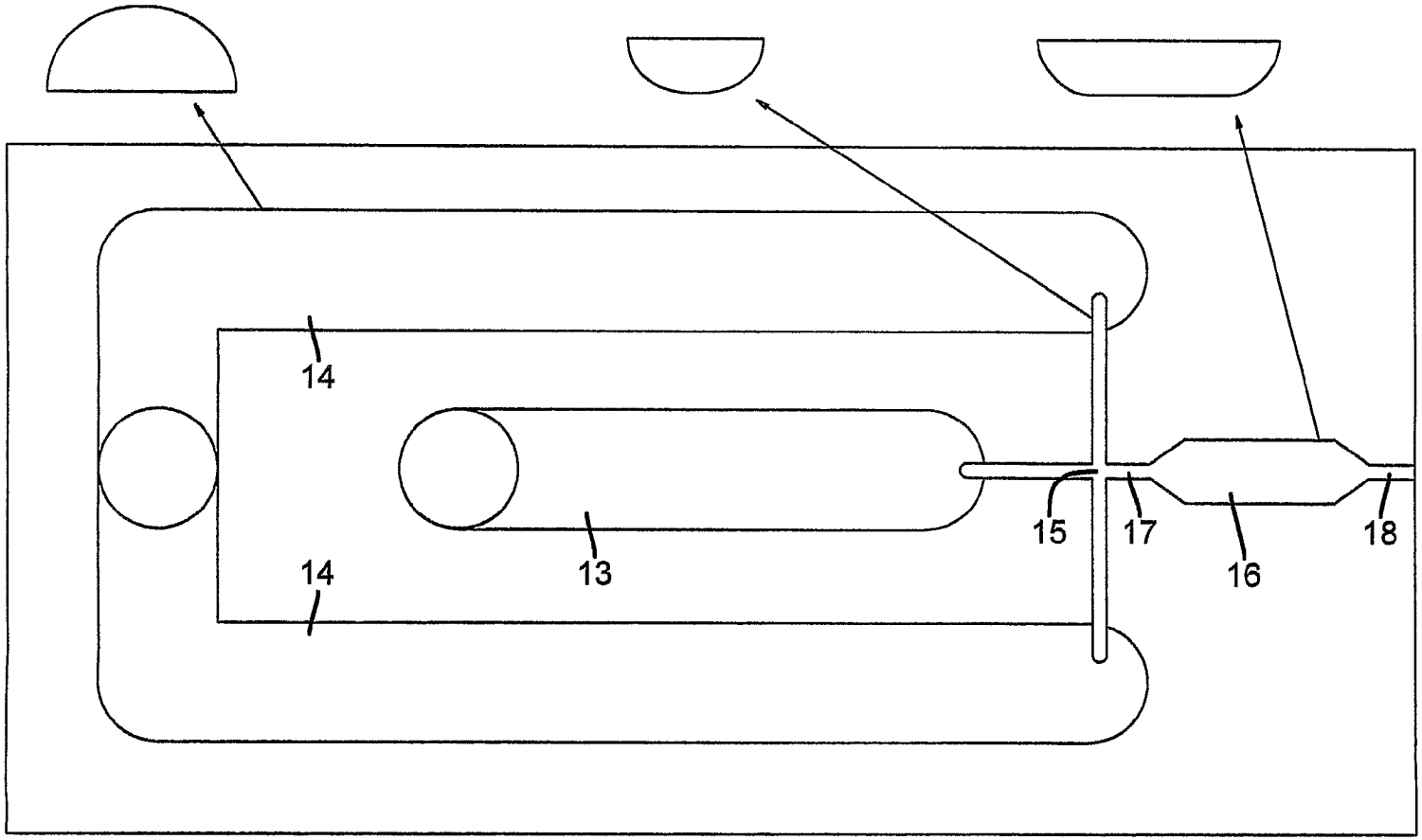
FIG. 4 is a schematic drawing of a device shown to perform the invention.

FIG. 4 is a schematic drawing of a device shown to perform the invention.

The device comprises a central arm 13 and upper and lower arms 14. The upper and lower arms meet the central arm at junction 15. This is a standard cross flow device. An expansion cavity 16 is located immediately downstream of the junction 15. The cavity has an entry nozzle 17 and an exit nozzle 18. The cross flow device is thus coupled via the cavity 16 to the exit nozzle 18. The cavity has a larger cross sectional area than the entry or exit nozzle. The device was fabricated from glass. It will be understood by those skilled in the art that any suitable material may be used to fabricate the device, including, but not limited to, hard materials such as ceramic, silicon, an oxide, a nitride, a carbide, an alloy or any material or set of materials suitable for use in one or more MEMS processing steps.

The flow-focussing device was supplied with deionised water containing 288 mg of SDS in 100 ml in both the upper and lower arms 14 at the same pressure. Oil (decane) was supplied in the central arm 13 and formed a narrow thread that broke into regular droplets in the broadened region of the pipe, i.e, in the cavity 16. As the oil droplets traversed the exit orifice 18 they initiated break-up of the forming composite jet such that an oil drop was encapsulated in each water drop. Furthermore the composite jet break-up was observed to occur significantly closer to the exit orifice when regular oil drops were forming.

The flow focussing device was, in a further experiment, supplied with air in the central arm 13 and deionised water in the upper and lower arms 14. In this case the air thread broke into bubbles in a regular way without forming a long thread of air within the cavity. This regular stream of bubbles nevertheless provided sufficient perturbation to the composite jet at the exit orifice that the composite jet broke at a very short distance into a regular stream of composite droplets. It will be appreciated that the composite droplets contain less liquid and therefore for a given drop size reduce the drying requirements.

Figure 5:
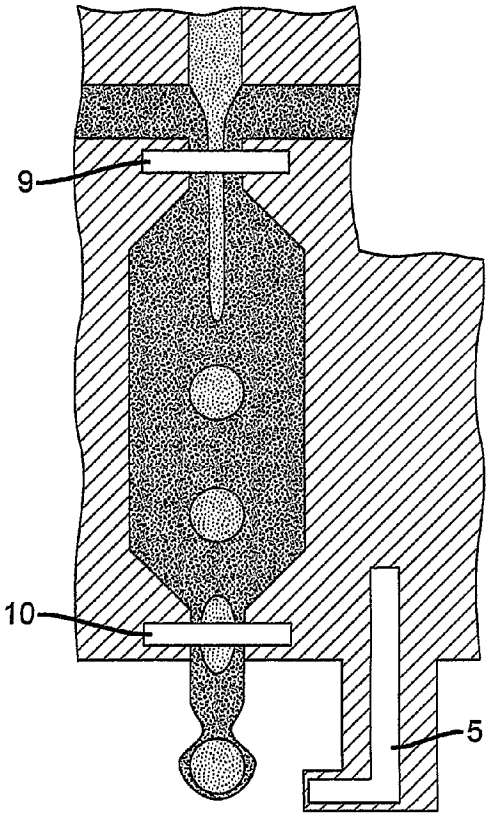
FIG. 5 is a schematic diagram of a generator device according to the invention.

FIG. 5 is a schematic diagram of a generator device according to the invention. This embodiment also includes an electrode 5 provided to charge the droplets as they form at the break up point. This electrode may be a separate device aligned with the nozzle or in a preferred embodiment may be formed as part of the droplet generator device using for example MEMs technology. Additionally, heaters 9 and 10 are provided at the entry and exit orifice respectively. These enable the phase of the drop generation to be fixed such that, for example, subsequent charging and/or deflection can be provided synchronously. The device according to the invention freely oscillates and therefore in a multi-nozzle printer each nozzle, even if at the same frequency, will be a random phase. In order to ensure the time of the drop is known and therefore can be placed as desired on the substrate the phase of each nozzle should preferably be set. Then for example, the voltage applied to the deflection plates can be timed to deflect the desired droplet. Alternatively a sensor may be provided on the exit orifice that also enables subsequent charging and/or deflection to be provided synchronously. Further, an imposed perturbation on the first fluid either directly, or via the second fluid will, if sufficiently great, cause the jet of the first fluid to break at the frequency of the imposed perturbation. Of course the condition $$f = (n + \beta)\frac{U_j}{L}$$

stated previously will enable certain frequencies to be generated more easily.

Figure 6:
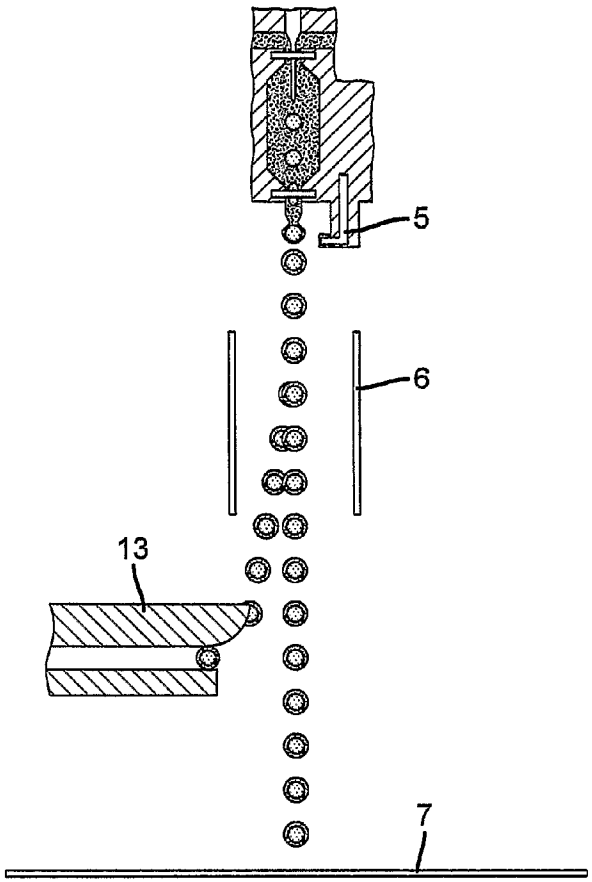
FIG. 6 is a schematic view of a printing system including the generator according to the invention.

FIG. 6 is a schematic view of a printing system including the droplet generator device according to the invention.

In this embodiment the droplet generator includes a MEMs fabricated electrode 5. The droplets ejected are each charged by the electrode. The stream of droplets subsequently passes through electrostatic deflection electrodes 6 and the droplets are selectively deflected. The deflection electrodes 6 cause some of the droplets to reach the substrate 7 on which they are to be printed and the rest to be caught and recirculated to the ink supply by a catching device 13.

Figure 7:
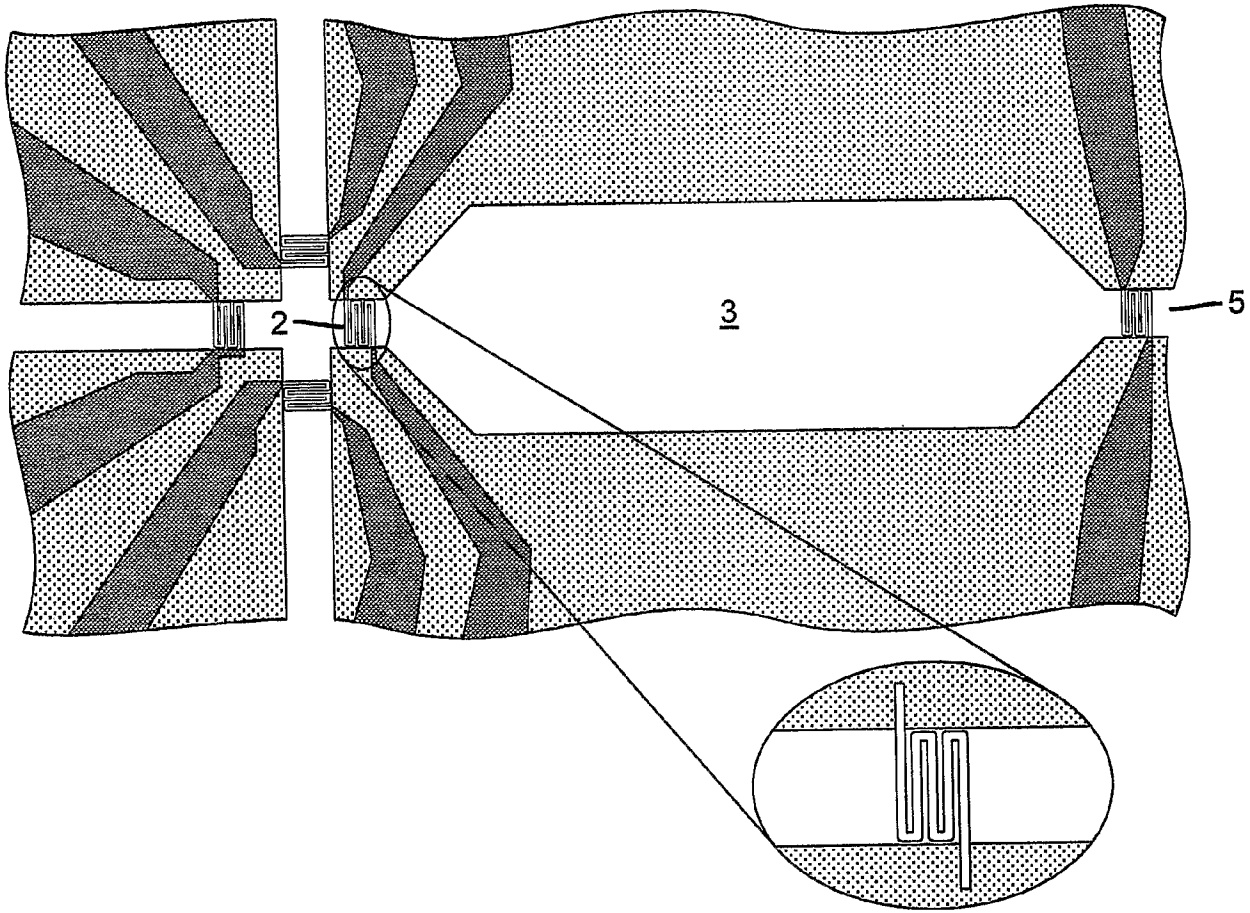
FIG. 7 illustrates an example device with heaters to provide a particular phase relation.

FIG. 7 shows a schematic diagram of a device that cascades a flow focussing device to a cavity device as described in relation to FIG. 1, and includes a means to perturb the liquid flows. A 20 nm film of platinum and a 10 nm film of titanium were evaporated on one face of a glass capillary to form a zig-zag resistive heater pattern over each entrance constriction and the exit constriction, the film of titanium being next to the glass surface. The zig zag pattern was a 2 micron wide track of overall length to give approximately 350 ohms resistance for the heater. The overall width was kept to a minimum to allow for the highest possible frequency of interaction with the flow. This width was approximately 18 microns. Each heater 30 could be energised independently. Whereas each heater had the desired effect, the heater over the cavity entrance constriction (2 in FIG. 1) was most efficient and was therefore used to collect the data shown in FIGS. 8 and 9.

Figure 8B:
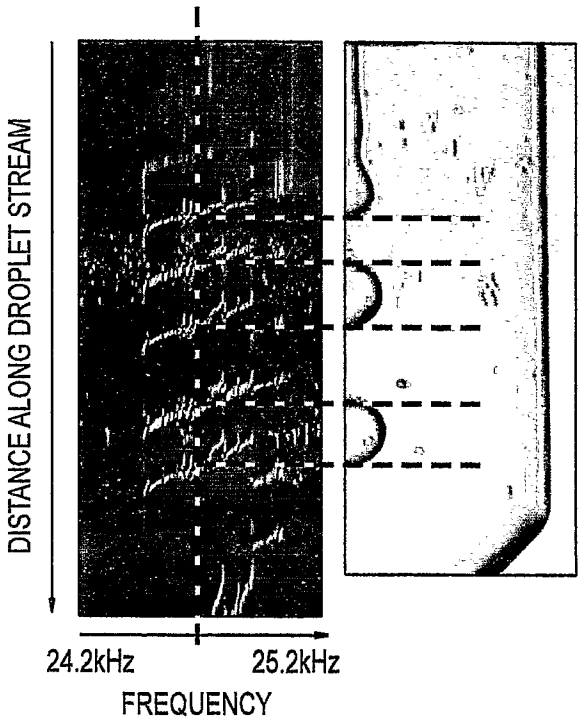
FIG. 8*a* is a copy of a photograph of internal drop formation with a heater perturbation active, 8*b* is an image compiled from a set of photographs as in FIG. 8*a;*
Figure 8A:
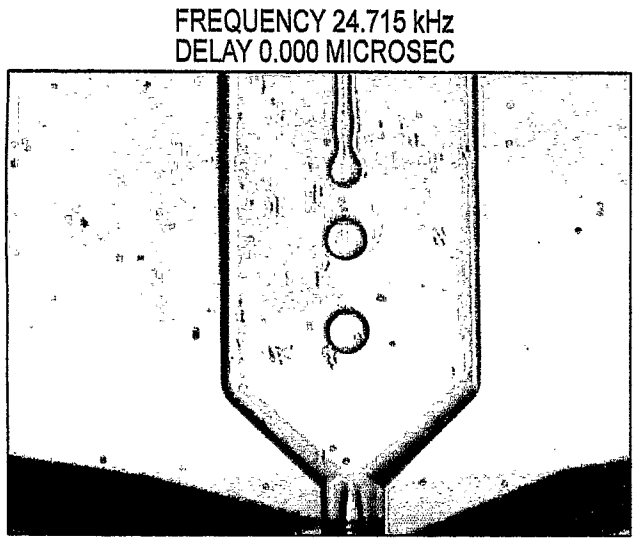

By pulsing the heater in phase with stroboscopic lighting it was possible to phase lock the internal drop breakup. The image is acquired using a standard frame transfer video camera running at 25 Hz, whereas the droplet formation is at around 25 kHz. A high brightness LED is used as the light source and flashes once for each droplet: Therefore each video frame is a multiple exposure of approximately 1000 pictures. If the droplets are synchronised with the light flashes then a single clear image is obtained, otherwise the multiple exposures lead to a blurred image with no distinct drops seen. The breakup phenomena could then be investigated as a function of the heater pulse frequency. FIG. 8*a* shows an image of internal drop breakup with the stroboscopic lighting phase locked with the heater pulse. The frequency was 24.715 kHz, the oil (drops) were decane and the external liquid was water. The decane was supplied at 41.1 psi and the water at 65.3 psi. The frequency was then varied from 24.2 kHz to 25.2 kHz in 5 Hz steps. For each image obtained the central line of pixels through the drops was extracted and used to form a column of pixels in a new image. The new image is shown in FIG. 8*b* where the y axis is distance along the channel centre and the x axis corresponds to frequency. The central region of the image in FIG. 8*b* show the existence of drops in phase with the strobe LED, whereas the left and right regions show no droplets, i.e. a blurred multiple exposure. Hence outside of a narrow band of frequencies the heater pulse was unable to phase lock the droplet formation This is a direct signature of resonant drop formation.

Figure 9:
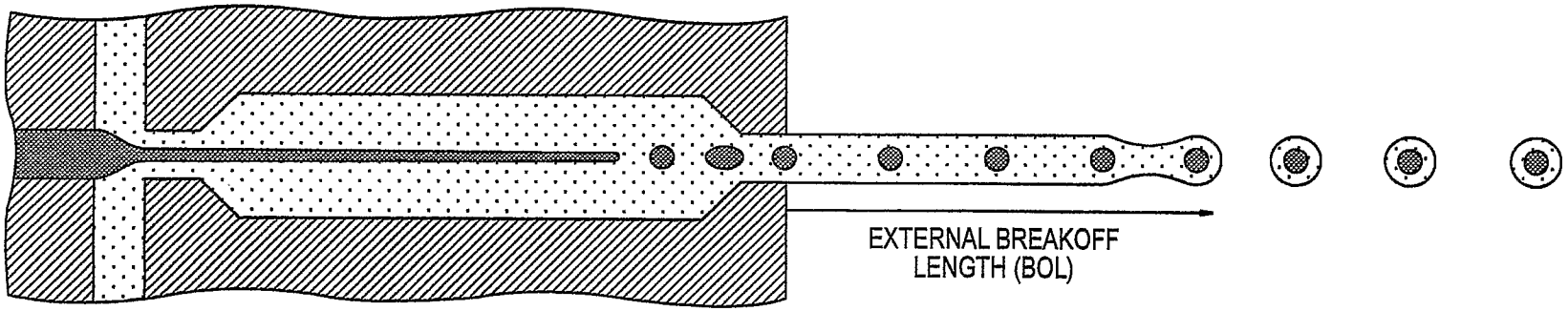
FIG. 9 illustrates the measure of external breakoff length.
Figure 10:
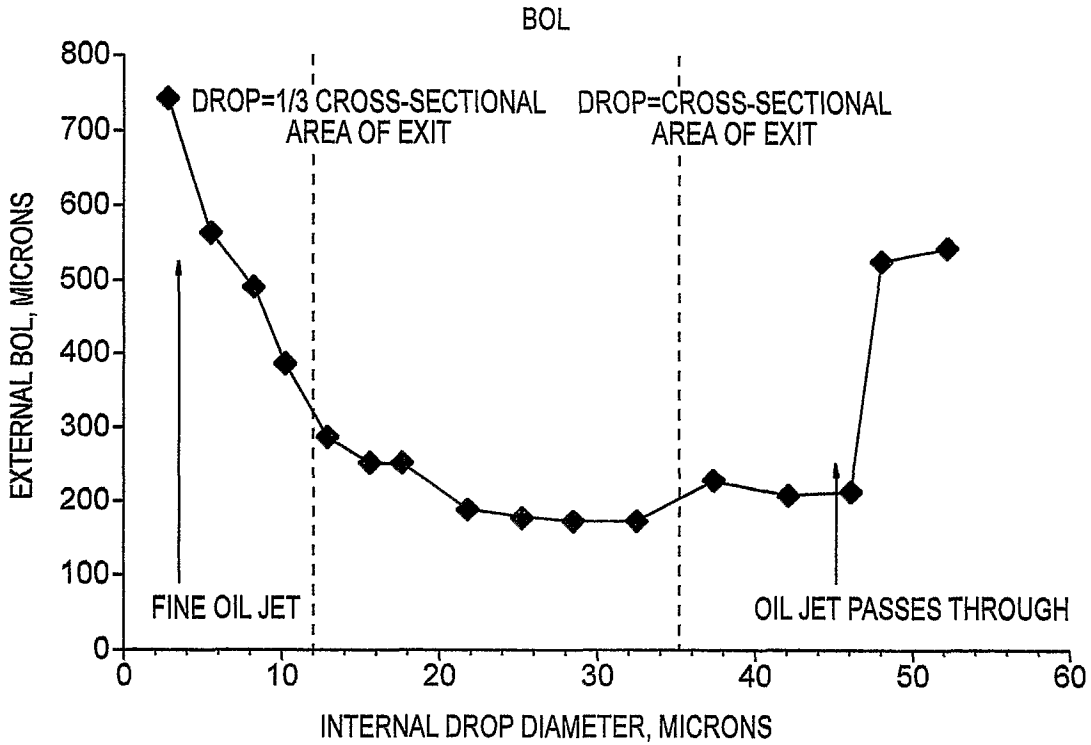
FIG. 10 illustrates data of external breakoff length as a function of internal drop size.

A further set of example data demonstrates the dependence of the resonant behaviour on internal drop size. When each internal drop passes the exit orifice it creates a pressure pulse that perturbs the flow and leads to resonance. If the exit orifice also forms a jet, then the pressure pulse also perturbs the jet and thereby causes the jet to break prematurely. Hence the external jet breakoff length is a good measure of the strength of the pressure perturbation. The external breakoff length measure is illustrated in FIG. 9. The ratio of the oil and water supply pressure was varied, keeping the total flow rate approximately constant. The diameter of the internal drops was thereby varied. The diameter of the internal drop was optically measured together with the breakoff length. External breakoff length is plotted as a function of drop internal drop diameter in FIG. 10. Note that since the drops have a diameter greater than the channel height they are flattened, and therefore the measured internal drop diameter is approximately proportional to the internal drop cross sectional area. FIG. 10 clearly indicates that the strong resonant behaviour occurs for internal drop cross-sections greater than about ⅓ of the exit orifice cross sectional area.

The invention has been described with reference to a composite jet of oil or air and an aqueous composition. It will be understood by those skilled in the art that the invention is not limited to such fluids. The invention is particularly applicable to liquids designed as inks and containing, for example, surface active materials such as surfactants or dispersants or the like, polymers, monomers, reactive species, latexes, particulates. Further, the first fluid may be a gaseous composition. This should not be taken as an exhaustive list The invention has been described in detail with reference to preferred embodiments thereof. It will be understood by those skilled in the art that variations and modifications can be effected within the scope of the invention.

The invention claimed is:

1. A droplet generating device for use as part of a continuous inkjet printer comprising:

an expansion cavity having an entry orifice and an exit orifice, the expansion cavity, the entry orifice, and the exit orifice each having a cross sectional area, the cross sectional area of the expansion cavity being larger than the cross sectional area of both the entry orifice and the exit orifice;

a nozzle located beyond the exit orifice; and a set of channels that provides a composite flow of a first fluid jet surrounded by a second fluid through the entry orifice and into the expansion cavity in which the jet of the first fluid surrounded by the second fluid breaks up in to drops of the first fluid surrounded by the second fluid as the first fluid moves toward the exit orifice, the exit orifice leading to the nozzle through which a composite flow of the drops of first fluid surrounded by the second fluid exits the droplet generating device as a fluid jet of drops of the first fluid surrounded by the second fluid, wherein passage of the drops of the first fluid through the exit orifice of the expansion cavity causes the first fluid jet of the composite flow of the first fluid jet surrounded by the second fluid to break into drops after the first fluid jet enters the expansion cavity through the entry orifice.

2. A device as claimed in claim 1 wherein the cross sectional area of the exit orifice, perpendicular to the flow direction, is less than approximately three times the cross sectional area of the droplets of the first fluid.

3. A droplet generating device for use as part of a continuous inkjet printer comprising a set of channels for providing a composite flow of a first fluid jet surrounded by a second fluid and an expansion cavity in which the jet of the first fluid surrounded by the second fluid break up in to drops of the first fluid surrounded by the second fluid, the expansion cavity having an entry orifice through which the composite flow of the first fluid jet surrounded by a second fluid enters the expansion cavity and an exit orifice, the exit orifice also forming a nozzle of an inkjet device through which a composite flow of the drops of first fluid surrounded by a second fluid exits the expansion cavity as a jet of fluid, the cross sectional area of the cavity being larger than the cross sectional area of both the entry orifice and the exit orifice, the passage of the droplets of the first fluid through the exit orifice causing the composite jet to break into composite droplets, wherein the first fluid is a liquid composition and breaks up into droplets at a distance approximately $L_B$ from the entrance of the cavity, the cavity being of length L and $L_B$ being greater than about (⅓)L, and $L_B$ being less than L.

4. A device as claimed in claim 1 including additional means to control the break up of the first fluid within the second fluid.

5. A device as claimed in claim 4 wherein the control means comprises a heater that perturbs the flow of at least one of the first fluid, the second fluid, and the composite of the first fluid and second fluid.

6. A device as claimed in claim 4 wherein the control means comprises an electrostatic field that perturbs the flow of at least one of the first fluid, the second fluid, and the composite of the first fluid and second fluid.

7. A device as claimed in claim 4 wherein the control means comprises a mechanical perturbation that perturbs the flow of at least one of the first fluid, the second fluid, and the composite of the first fluid and second fluid.

8. A device as claimed in claim 1 wherein charging means are provided adjacent the exit nozzle to charge the composite droplets.

9. A device as claimed in claim 1 fabricated from a hard material.

10. A device as claimed in claim 9 wherein the channels are fabricated substantially from a hard material chosen from one or more of glass, ceramic, silicon, an oxide, a nitride, a carbide, an alloy, a material or set of materials suitable for use in one or more MEMs processing steps.

11. A method of forming droplets at high frequency and high velocity in gas comprising:

supplying a first fluid jet and a second fluid within a set of channels, the interface of the fluids being characterised by an interfacial tension or an interfacial elasticity, the second fluid surrounding the first fluid jet to form a composite flow of the first fluid jet surrounded by the second fluid;

providing an expansion cavity in fluid communication with the set of channels, the expansion cavity having an entry orifice and an exit orifice, the expansion cavity, the entry orifice, and the exit orifice each having a cross sectional area, the cross sectional area of the expansion cavity being larger than the cross sectional area of both the entry orifice and the exit orifice;

causing the composite flow of the first fluid jet surrounded by the second fluid to enter the expansion cavity through the entry orifice, the first fluid jet breaking into droplets within the second fluid within the expansion cavity to form a composite flow of droplets of the first fluid surrounded by the second fluid; and causing the composite flow of droplets of the first fluid surrounded by the second fluid to exit from the exit orifice of the expansion cavity as a fluid jet of the composite flow of drops of the first fluid surrounded by the second fluid, wherein passage of the droplets of the first fluid through the exit orifice causes the first fluid jet of the composite flow of the first fluid jet surrounded by the second iet to break into droplets after the first fluid jet enters the expansion cavity through the entry orifice.

12. A method as claimed in claim 11 wherein the fluids flow through a cavity in which the cross sectional area of the exit orifice, perpendicular to the flow direction, is less than approximately three times the cross sectional area of the droplets of the first fluid.

13. A method of forming droplets at high frequency and high velocity in gas comprising supplying a first fluid jet and a second fluid within a set of channels, the interface of the fluids being characterised by an interfacial tension or an interfacial elasticity, the second fluid surrounding the first fluid jet to form a composite flow of the first fluid jet surrounded by the second fluid, the composite flow of the first fluid jet surrounded by the second fluid entering an expansion cavity through an entry orifice, the first fluid jet breaking into droplets within the second fluid within the expansion cavity to form a composite flow of droplets of the first fluid surrounded by the second fluid, the composite flow of droplets of the first fluid surrounded by the second fluid exiting the expansion chamber through an exit orifice, the cross sectional area of the expansion cavity being larger than the cross sectional area of both the entry orifice and the exit orifice, the composite flow of droplets of the first fluid surrounded by the second fluid forming a composite jet on exit from the exit orifice, the passage of the droplets of the first fluid through the exit orifice causing the composite jet to break into composite droplets, wherein the first fluid breaks up into droplets at a distance approximately $L_B$ from the entrance of the cavity, the cavity being of length L and $L_B$ being greater than about (⅓)L, and $L_B$ being less than L.

14. A method as claimed in claim 11 additionally including control of the break up of the first fluid within the second fluid.

15. A method as claimed in claim 14 wherein a heater perturbs the flow of at least one of the first fluid, the second fluid, and the composite of the first fluid and second fluid.

16. A method as claimed in claim 14 wherein an electrostatic field perturbs the flow of at least one of the first fluid, the second fluid, and the composite of the first fluid and second fluid.

17. A method as claimed in claim 14 wherein a mechanical perturbation perturbs the flow of at least one of the first fluid, the second fluid, and the composite of the first fluid and second fluid.

18. A method as claimed in claim 11 wherein the composite droplets are charged adjacent the exit nozzle.

19. A continuous inkjet printing apparatus comprising one or more droplet generation devices according to claim 1.

20. A device as claimed in claim 1 wherein the exit orifice also forms the nozzle of an inkjet device.

* * * * *